US005680951A

United States Patent [19]

Feltman, III et al.

[11] Patent Number: 5,680,951

[45] Date of Patent: Oct. 28, 1997

[54] FLOW CONTROL COVER FOR A CUP

[76] Inventors: Charles H. Feltman, III, 2569 Marian Way; Dirk G. Laner, 519 High St., both of San Luis Obispo, Calif. 93401; Bernard Strong, 4964 Calvin Ave., Tarzana, Calif. 91356

[21] Appl. No.: 511,784

[22] Filed: Aug. 7, 1995

[51] Int. Cl.[6] ..... B65D 51/18

[52] U.S. Cl. ..... 220/253; 220/710.5; 220/713

[58] Field of Search ..... 220/253, 254, 220/301, 302, 212, 212.5, 255, 256, 703, 713, 710.5, 711, 716, 718, 719; 265/228, 236, 386, 387; 222/277, 519

[56] References Cited

U.S. PATENT DOCUMENTS

| | | | |
|---|---|---|---|
| 98,586 | 1/1870 | Haller . | |
| 303,558 | 8/1884 | Campbell . | |
| 966,748 | 8/1910 | Honecker . | |
| 1,593,846 | 7/1926 | Reid | 220/302 |
| 1,736,350 | 11/1929 | Larsen . | |
| 1,818,581 | 8/1931 | Reid | 220/302 |
| 1,842,261 | 1/1932 | Garwood . | |
| 1,943,779 | 1/1934 | Zay | 220/302 |
| 2,292,726 | 8/1942 | Trippensee . | |
| 2,462,445 | 2/1949 | Weiss . | |
| 2,753,074 | 7/1956 | Schmid . | |
| 3,443,716 | 5/1969 | Evans . | |
| 3,784,047 | 1/1974 | Cooper . | |
| 4,084,330 | 4/1978 | Fraser . | |
| 4,190,173 | 2/1980 | Mason et al. | 220/715 X |
| 4,380,302 | 4/1983 | Broad . | |
| 4,401,228 | 8/1983 | Baldelli . | |
| 4,440,309 | 4/1984 | Morimoto . | |
| 4,582,218 | 4/1986 | Ross . | |
| 4,895,281 | 1/1990 | Lorenz | 222/519 X |
| 5,018,636 | 5/1991 | Ross . | |
| 5,102,000 | 4/1992 | Feltman, III . | |
| 5,109,997 | 5/1992 | Phillips . | |
| 5,294,014 | 3/1994 | Wyatt et al. | 220/253 |
| 5,421,472 | 6/1995 | Beckertgis | 220/253 |

FOREIGN PATENT DOCUMENTS

| | | | |
|---|---|---|---|
| 128789 | 10/1945 | Australia . | |
| 248645 | 12/1963 | Australia | 220/253 |
| 484633 | 10/1929 | Germany . | |
| 3804986 | 8/1989 | Germany . | |

*Primary Examiner*—Allan N. Shoap
*Assistant Examiner*—Nathan Newhouse
*Attorney, Agent, or Firm*—Pretty, Schroeder & Poplawski

[57] ABSTRACT

A cover for a cup, the cover comprising a cap and a lid, with the cap mountable on a cup, with the lid rotatably attached to the cap and with the cap and lid having openings for fluid flow from the cup when the openings are in alignment. The cap-lid attachment includes a first ring on the cap and a second ring on the lid, with the second ring rotating within the first ring, and with the second ring having resilient fingers projecting from the second ring past the first ring, with outwardly projecting hooks at the end of the fingers for latching the rings together. The first ring has projecting stops for engagement by the second ring hooks for limiting rotation of the lid between aligned and non-aligned positions of the openings, with the cap and lid having bands with openings therein, with the lid band overlying the cap band, and with the cap band having a rib around the cap openings and in sealing engagement with the lid band.

6 Claims, 4 Drawing Sheets

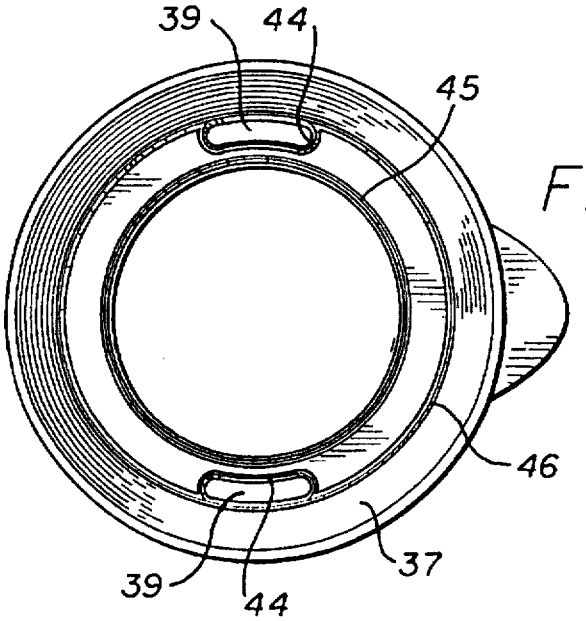
FIG. 5
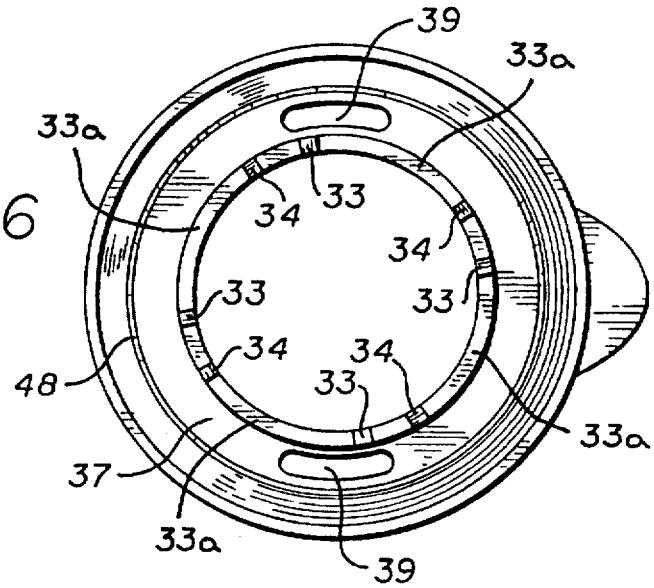
FIG. 6
FIG. 7
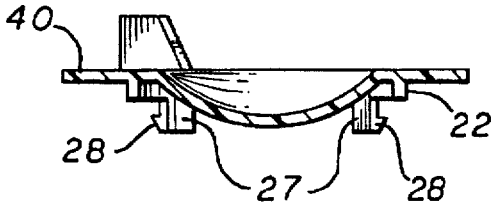

FLOW CONTROL COVER FOR A CUP

BACKGROUND OF THE INVENTION

This invention relates to cups, especially cups with handles, sometimes known as mugs, suited for holding hot or cold liquids for drinking. The most common use to date for such containers is for hot coffee.

Consumers like to have their drinks remain at or near the initial temperature, whether hot or cold, and various types of covers have been developed for such use. Typical mugs suitable for hot coffee and the like are shown in U.S. Pat. Nos. 4,582,218, 5,018,636 and 5,102,000. These prior patents show a mug with a one piece cover, and no openings that can be aligned for drinking and rotated to a non-aligned condition for sealing the openings.

A satisfactory cover must be easily removed from and replaced on the cup or mug, provide some means for drinking from the container through or around the cover, and desirably provide for opening and closing the drinking access to reduce heat flow through the drinking opening or openings.

SUMMARY OF THE INVENTION

Accordingly, it is an object of the present invention to provide a new and improved cover for a cup which is readily mounted on and removed from the cup and which provides one or more drinking openings through the cover which openings may be opened and closed by the user.

In the presently preferred embodiment of the cover for a cup, the cover comprises a cap and a lid, with the cap having mounting means for mounting the cap on a cup. The cap and lid have interengaging attachment means for attaching the lid to the cap for rotation of the lid relative to the cap, with the cap and lid having openings for fluid flow from the cup when the openings are in alignment, with the lid being rotatable between a full flow position with the openings in alignment and a no-flow position with the openings out of alignment. Also the lid may be set at any location between the full flow and no-flow positions for adjusting the rate of flow.

The attachment means preferably includes a first ring on the cap and a second ring on the lid, with the second ring rotating within the first ring, and with the second ring including resilient fingers projecting from the second ring past the first ring, with an outwardly projecting hook at the end of a finger for latching the rings together, and with projecting stop means on the first ring for engagement by the second ring hook for limiting rotation of the lid between aligned and non-aligned positions of the openings.

Also the cap and lid preferably have bands with the openings therein, with the lid band overlying the cap band, and with the cap band having a rib around the cap opening and in sealing engagement with the lid band, and further with the cap band having concentric ribs in sealing engagement with the lid band.

The preferred specific design also has an additional annular rib opposite the concentric ribs for sealing engagement with the cup, and the lid has a concave bowl within the lid band and upwardly projecting tabs for manual rotation of the lid in the cap.

Other objects, advantages, features and results will more fully appear in the course of the following description.

BRIEF DESCRIPTION OF THE DRAWINGS

FIG. 5 is a top view of the cap;

FIG. 6 is a bottom view of the cap; and

FIG. 7 is a side view of the lid.

DESCRIPTION OF THE PREFERRED EMBODIMENTS

Figure 1:
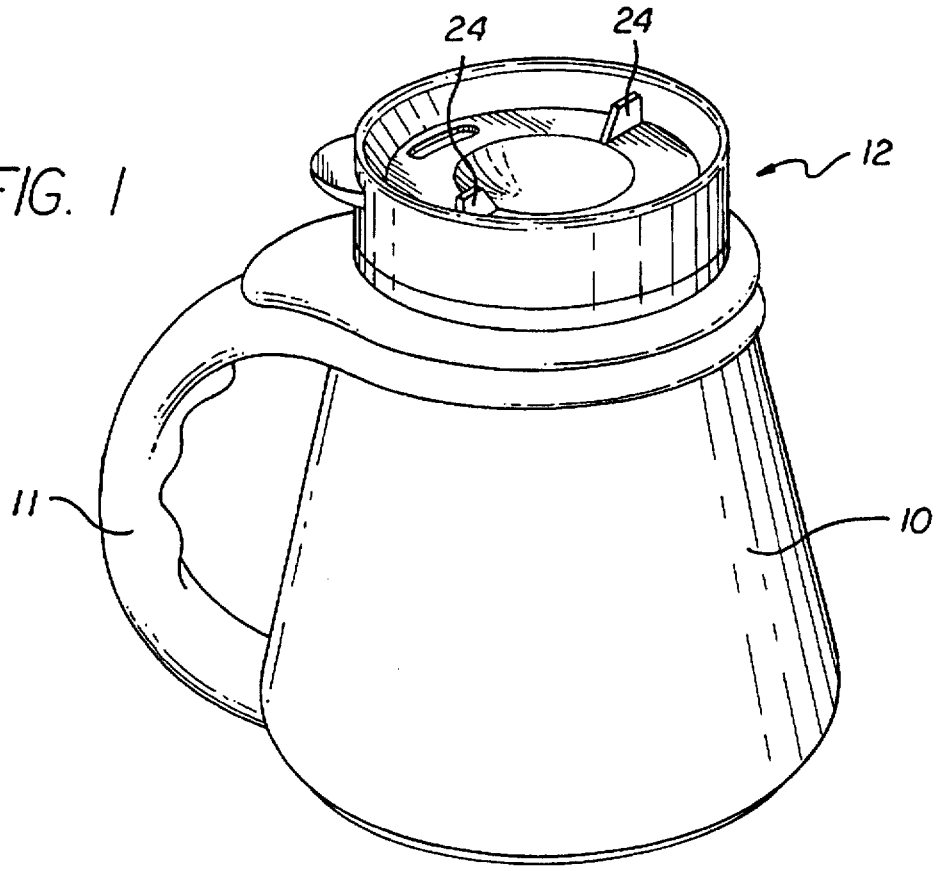
FIG. 1 is a perspective view of a drinking cup with cover incorporating the presently preferred embodiment of the invention.
Figure 3:
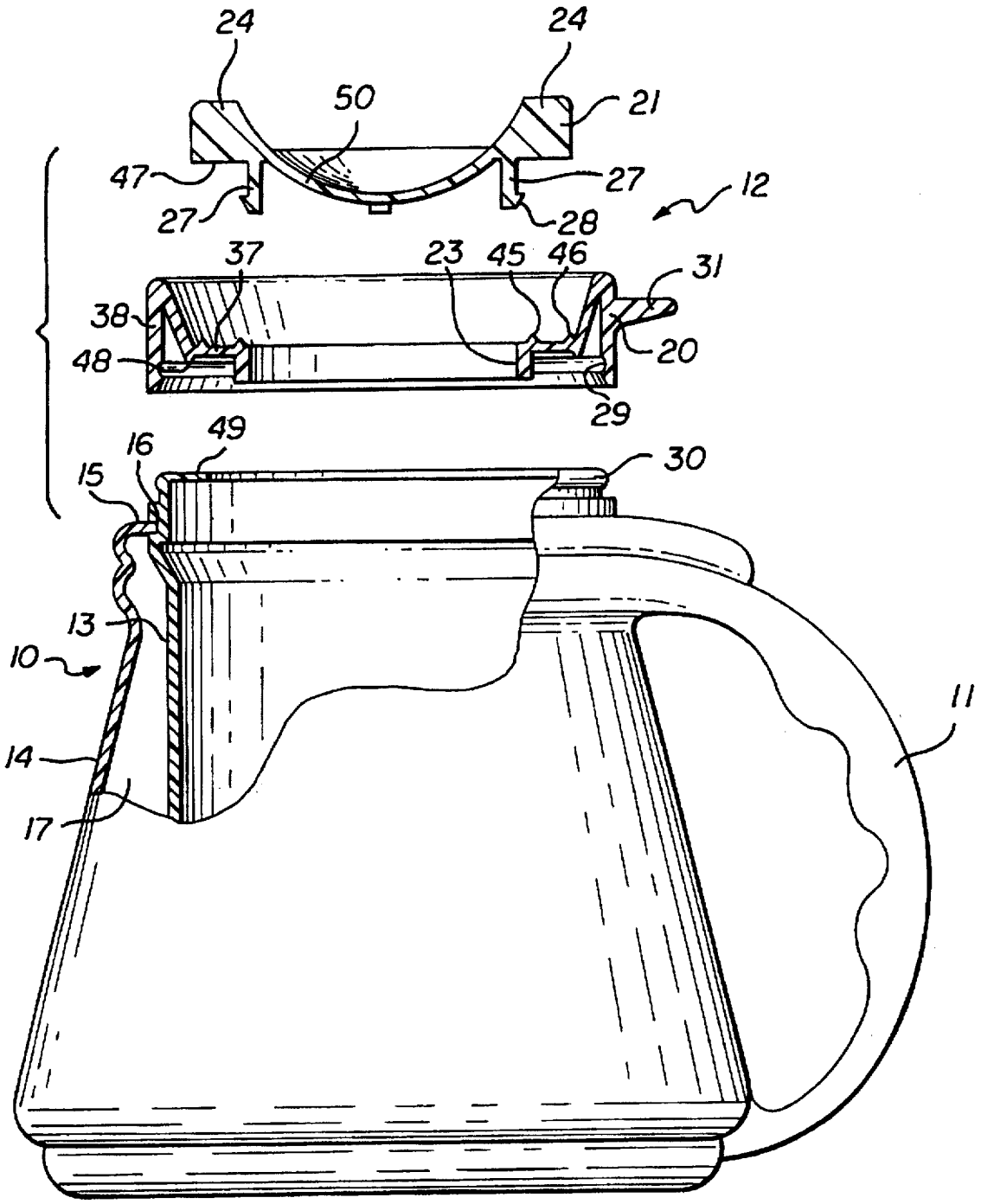
FIG. 3 is an exploded side view, partly in section, of the cup of FIGS. 1 and 2.

FIG. 1 shows a container or cup 10 with a handle 11 and a removable cover 12. As best seen in FIG. 3, the cup preferably has an inner lining 13 and an outer shell 14, with the two components molded of plastic. A rim 15 of the outer shell fits into a groove 16 of the inner lining to make a substantially air tight fit, thereby providing a closed space 17 between the lining and shell which acts as a thermal barrier.

The cover 12 includes a cap 20 and a lid 21, with the lid rotatably mounted in the cap. The cap and lid typically are plastic moldings, with the lid having a ring 22 fitting within a ring 23 of the cap. Preferably, the lid has upwardly directed opposed tabs 24 providing for manual rotation of the lid within the cap.

Figure 4:
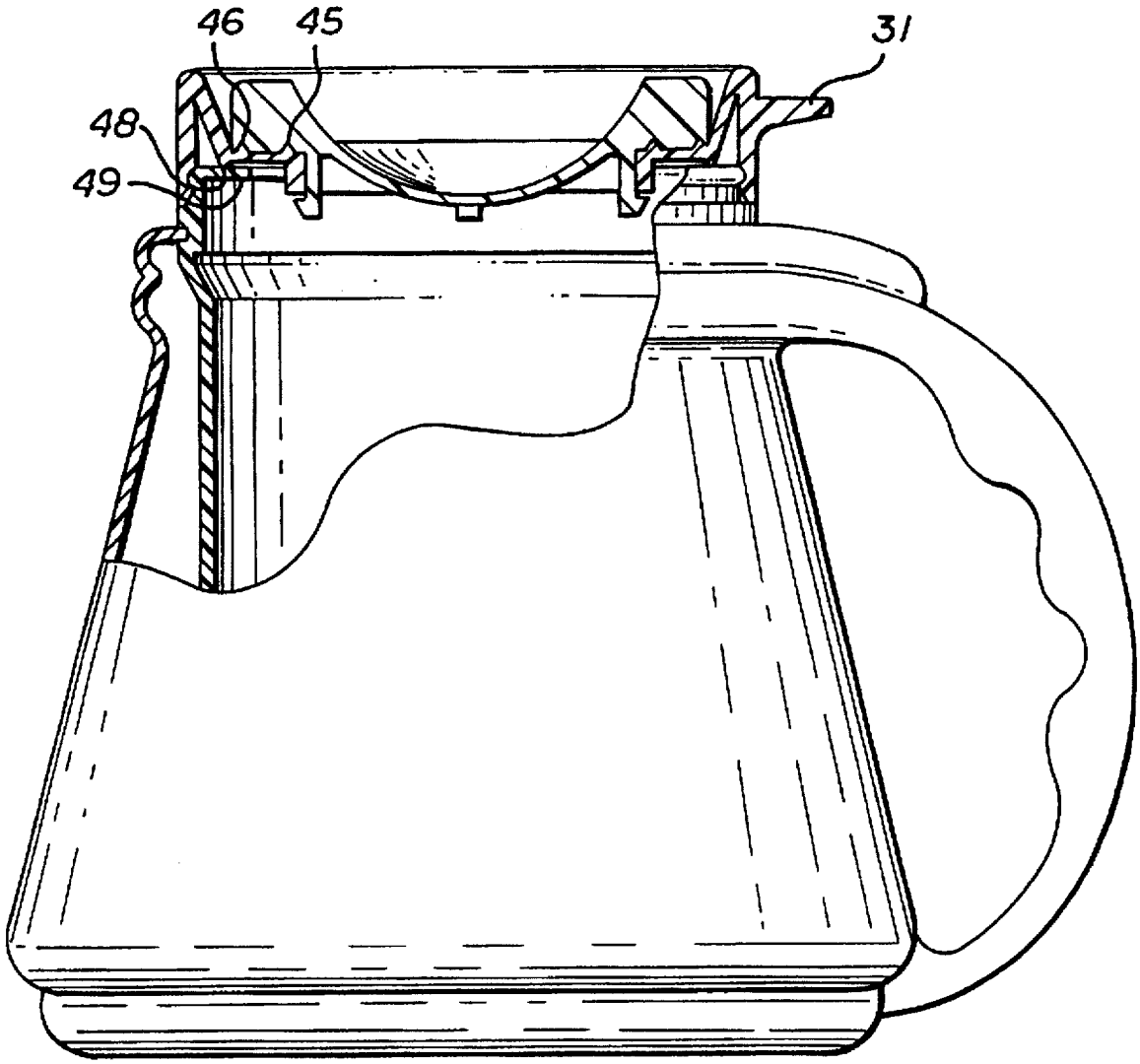
FIG. 4 is a view similar to that of FIG. 3 showing the cover with cap and lid mounted on the cup.

Resilient fingers 27, four in the embodiment illustrated, project downward from the ring 22, with a hook 28 at the lower end of each finger. With this construction, the lid 21 is a push fit into the cover 20, bringing the lid into the cover as shown in FIG. 4, with the hooks 28 under the ring 23 of the cover, holding the components together. Preferably the lower ends of the hooks are tapered for easier insertion of the lid into the cap. The two components may be separated by flexing one or more fingers inward and pushing the lid upward relative to the cap. In an alternative construction, mating threads could be provided on the rings 22, 23 in place of the fingers 27 and hooks 28 for joining the lid and cap, for a screw-on attachment rather than a snap-on attachment.

Typically, the cap has an inner groove 29 for receiving an outer rim 30 of the cup for retaining the cover on the cup. The material for the cap is slightly flexible so that the cover can be pushed down onto the cup to engage the rim 30 in the groove 29, and raised up from a cup to separate the components. A tab 31 may be provided on the cap to aid in lifting the cover from the cup. In an alternative construction, mating threads may be used on the cap and cup in place of the groove 29 and rim 30, for a screw-on attachment rather than a snap-on attachment.

A set of downwardly projecting bosses 33 are provided on the lower edge of the cap ring 23, with a boss for each of the resilient fingers, and another set of similar bosses 34 are provided spaced from the bosses 33. Engagement of resilient fingers 27 with bosses 33 limits rotation of the lid in one direction to the flow position, and engagement of the fingers with the bosses 34 limits rotation of the lid in the opposite direction to a no-flow position. The portions **33*a* of the cap ring 23 between bosses 33 and 34** may have a ramp profile to increase the sealing pressure between the cap and lid as the lid is rotated from the flow position to the no-flow position. The design of the present invention provides improved sealing thereby reducing heat loss and leakage of the contents. If it is desired to have a mug with a lid that rotates 360° the stops could be omitted.

A band 37 is provided in the cap between the ring 23 and an outer shell 38. One or more openings 39 are provided in this band. A similar band 40 is provided in the lid with one or more openings 41 in this band for alignment with the openings 39 of the cap when the lid is rotated to the flow position. When the lid is rotated to the no-flow position as shown in FIG. 2, the openings 41 are not in alignment with the openings 39 of the cap.

Preferably, a sealing arrangement is provided with the cap and lid for preventing or reducing leakage when the lid is in the no-flow position. In the preferred embodiment illustrated, a seal rib 44 is provided on the band 37 around each of the openings 39. Also concentric annular seal ribs 45, 46 may be provided on the band 37. These ribs 44, 45, 46 will engage the lower surface 47 of the band 40 of the lid to provide the desired sealing. In addition, another annular seal rib 48 may be provided on the lower face of the band 37 of the cap for engagement with a flange 49 of the inner lining 13. In an alternative construction, an O-ring seal can be substituted for the rib 46, preferably with aligned grooves in the lid and cap for receiving the O-ring. The central portion 50 of the lid may be concave or bowl shaped to provide clearance for the user.

In operation, the cover with lid and cap is removed from the cup, as by gripping the cup at the handle 11 and pushing upward on the tab 31 with a thumb. When the cover is removed, the cup is filled with the desired liquid. Then the cover is repositioned on the cup by pressing downward. The lid is rotated in the cap to the position of FIGS. 1 and 2, with the openings of the cap and lid not in alignment.

Figure 2:
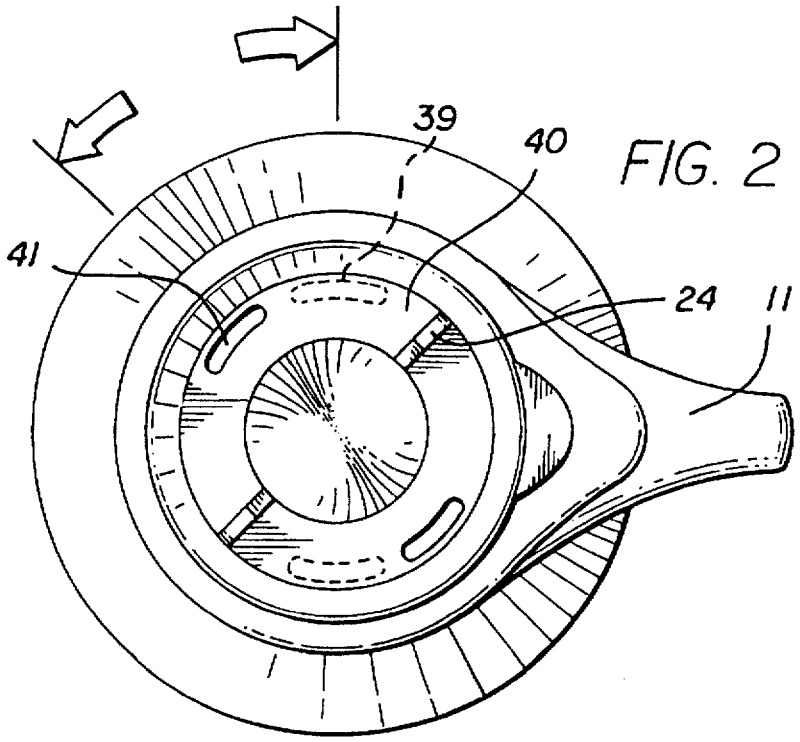
FIG. 2 is a top view of the cup of FIG. 1.

When the user desires to drink from the cup, the lid is rotated by the tabs 24 from the no-flow position of FIG. 2 to a flow position with the openings 39, 41 in alignment. In the specific design shown in the drawings, two openings 39 are provided, opposed to each other and at 90° to the handle. This arrangement provides for ease in drinking with either hand. After taking a drink, the user rotates the lid in the opposite direction to the no-flow condition, thereby reducing the heat loss and the likelihood of spilling.

An advantage of the present design is that the user is prompted to always place the cap on the mug before use, thereby reducing the likelihood of spilling the liquid if the mug is dropped or turned over.

We claim:

1. A cover for a cup, said cover comprising a cap and a lid, said cap having mounting means for mounting said cap on said cup, said cap and said lid having interengaging attachment means for attaching said lid to said cap for rotation of said lid relative to said cap, said cap and said lid having openings for fluid flow from the cup when said openings are in alignment, said lid being rotatable between a flow position with said openings in at least partial alignment and a no-flow position with said openings out of alignment, said attachment means including a first ring on said cap and a second ring on said lid, with said second ring rotating within said first ring, said second ring including resilient fingers projecting from said second ring past said first ring, with an outwardly projecting hook at the end of one said finger for latching said rings together, said first ring having projecting stop means for engagement by said second ring hook for limiting rotation of said lid between aligned and non-aligned positions of said openings, and with portions of said first ring between said stop means have a ramp profile:

said cap and said lid having bands with said openings therein, with said lid band overlying said cap band, and with said cap band having a rib around said cap opening and in sealing engagement with said lid band, and with said cap band having concentric annular ribs in sealing engagement with said lid band.

2. A cover as defined in claim 1 with said cap band having an additional annular rib opposite said concentric ribs for sealing engagement with the cup.

3. A cover as defined in claim 2 wherein said lid has a concave bowl within said lid band and upwardly projecting tabs for manual rotation of said lid in said cap.

4. A cover for a cup, said cover comprising a cap and a lid, said cap having mounting means for mounting said cap on said cup, said cap and said lid having interengaging attachment means for attaching said lid to said cap for rotation of said lid relative to said cap, said cap and said lid having openings for fluid flow from the cup when said openings are in alignment, said lid being rotatable between a flow position with said openings in at least partial alignment and a no-flow position with said openings out of alignment, said attachment means including a first ring on said cap and a second ring on said lid, with said second ring rotating within said first ring, said second ring including resilient fingers projecting from said second ring past said first ring, with an outwardly projecting hook at the end of one said finger for latching said rings together, said first ring having projecting stop means for engagement by said second ring hook for limiting rotation of said lid between aligned and non-aligned positions of said openings, and wherein said cap and lid have planar bands with said openings therein, with said cap band having concentric annular ribs in sealing engagement with said lid band.

5. A cover for a cup, said cover comprising a cap and a lid, said cap having mounting means for mounting said cap on said cup, said cap and said lid having interengaging attachment means for attaching said lid to said cap for rotation of said lid relative to said cap, said cap and said lid having openings for fluid flow from the cup when said openings are in alignment, said lid being rotatable between a flow position with said openings in at least partial alignment and a no-flow position with said openings out of alignment, said attachment means including a first ring on said cad and a second ring on said lid, with said second ring rotating within said first ring, said cap and said lid having bands with said openings therein, with said lid band overlying said cap band, and with said cap band having a rib around said cap opening and in sealing engagement with said lid band, with said cap band having concentric annular ribs in sealing engagement with said lid band.

6. A cover as defined in claim 5 with said cap band having an additional annular rib opposite said concentric ribs for sealing engagement with the cup.

* * * * *